US009950198B2

(12) United States Patent
Johnson et al.

(10) Patent No.: US 9,950,198 B2
(45) Date of Patent: Apr. 24, 2018

(54) MULTI-MISSION REBREATHER COOLING SYSTEM

(71) Applicant: O2 Dive Technologies, Inc., Houston, TX (US)

(72) Inventors: Mark Alan Johnson, Houston, TX (US); Gene Melton, Houston, TX (US)

(73) Assignee: O2 Dive Technologies, Inc., Houston, TX (US)

( * ) Notice: Subject to any disclaimer, the term of this patent is extended or adjusted under 35 U.S.C. 154(b) by 687 days.

(21) Appl. No.: 14/498,401

(22) Filed: Sep. 26, 2014

(65) Prior Publication Data

US 2015/0007593 A1 Jan. 8, 2015

Related U.S. Application Data

(63) Continuation-in-part of application No. 13/306,383, filed on Nov. 29, 2011, now abandoned.

(60) Provisional application No. 61/417,656, filed on Nov. 29, 2010.

(51) Int. Cl.

| | |
|---|---|
| ***A62B 7/10*** | (2006.01) |
| ***A62B 19/00*** | (2006.01) |
| ***B63C 11/24*** | (2006.01) |
| ***F25B 1/00*** | (2006.01) |
| ***F25B 49/00*** | (2006.01) |

(52) U.S. Cl.

CPC ..... *A62B 7/10* (2013.01); *A62B 19/00* (2013.01); *B63C 11/24* (2013.01); *F25B 1/005* (2013.01); *F25B 49/00* (2013.01)

(58) Field of Classification Search

CPC ..... A62B 7/00–7/14; A62B 9/00–9/06; A62B 19/00–19/02; A62B 25/00–25/005; A61M 16/0045; A61M 16/1075; A61M 16/1095; A61M 16/122; A61M 16/22; A61M 2205/3606; A61M 2205/366; B63C 11/24

See application file for complete search history.

(56) References Cited

U.S. PATENT DOCUMENTS

| | | | | |
|---|---|---|---|---|
| 2,125,727 A * | 8/1938 | Kalischer | ..... | F24F 1/022 62/238.6 |
| 2,502,263 A * | 3/1950 | Lewis | ..... | A61G 10/04 128/204.15 |
| 2,702,546 A * | 2/1955 | Gilroy | ..... | A61G 10/04 128/204.16 |

(Continued)

*Primary Examiner* — Valerie L Woodward

(74) *Attorney, Agent, or Firm* — Osha Liang LLP

(57) ABSTRACT

An apparatus includes a scrubber bed, a cooling unit operatively connected to the scrubber bed, and a frame configured for a user to carry the apparatus. The cooling unit includes a compressor, a condensing coil operatively connecting the compressor to an expansion valve, and an evaporating coil operatively connecting the expansion valve to the compressor, and a first fluid circulating through the compressor, the condensing coil, the expansion valve, and the evaporating coil. A method of cooling a gas in a rebreather apparatus includes scrubbing an exhalation gas to produce a recycled gas having a lower concentration of carbon dioxide than the exhalation gas, compressing, condensing, expanding, and evaporating a refrigerant in a closed-loop system, transferring heat energy from the recycled gas to the refrigerant, and metering a cooled gas to the user.

11 Claims, 7 Drawing Sheets

(56) References Cited

U.S. PATENT DOCUMENTS

| | | | | | |
|---|---|---|---|---|---|
| 3,266,489 | A * | 8/1966 | Williams | A62B 7/10 | 128/202.19 |
| 3,385,293 | A * | 5/1968 | Phillips | A61M 16/06 | 128/204.16 |
| 4,586,500 | A * | 5/1986 | Glynn | A62B 9/003 | 128/204.15 |
| 8,302,603 | B1 * | 11/2012 | Weber | A62B 7/02 | 128/204.18 |
| 2007/0215159 | A1 * | 9/2007 | Ross | A62B 7/08 | 128/205.28 |

* cited by examiner

MULTI-MISSION REBREATHER COOLING SYSTEM

CROSS-REFERENCE TO RELATED APPLICATIONS

This application is a continuation-in-part of U.S. patent application Ser. No. 13/306,383, filed on Nov. 29, 2011, which claims the priority of provisional application under 35 U.S.C. § 119(e), namely U.S. Patent Application No. 61/417,656 filed on Nov. 29, 2010, both of which are incorporated by reference in their entireties herein.

BACKGROUND

The present disclosure relates to a portable breathing apparatus. More specifically, the present disclosure relates to portable, surface rebreather breathing apparatus having a cooling system.

A rebreather is a closed loop breathing apparatus. A user exhales into the rebreather and the exhalant gas stream enters a scrubber bed. The scrubber bed chemically absorbs carbon dioxide ($CO_2$) from the exhalant gas stream but allows the other components of the exhalant gas stream to pass through. Oxygen is added to the scrubbed exhalant gas stream to make up for any oxygen absorbed by the user during rebreather use. The O2 enriched scrubbed exhalant gas continues through the apparatus to be inhaled by the user.

The scrubbing of the $CO_2$ in the scrubber bed creates an exothermic reaction, i.e., a temperature change. In some cases, the temperature of the scrubber bed can increase up to about 150 degrees Fahrenheit (about 66 degrees Celsius). Because the rebreather apparatus is a closed loop system, the temperature increase of the scrubber bed increases the temperature of the scrubbed exhalant gas. A temperature increase in the scrubbed exhalant gas can cause the user discomfort. Some surface rebreathers use ice blocks to cool the scrubbed exhalant gas to alleviate any discomfort for the user.

Accordingly, there exists a need for a more efficient cooling system in a closed-loop surface rebreather apparatus that also allows for multiple missions.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an apparatus that includes a scrubber bed, a cooling unit operatively connected to the scrubber bed, and a frame configured for a user to carry the apparatus. The cooling unit includes a compressor, a condensing coil operatively connecting the compressor to an expansion valve, an evaporating coil operatively connecting the expansion valve to the compressor, and a first fluid circulating through the compressor, the condensing coil, the expansion valve, and the evaporating coil.

In another aspect, embodiments disclosed herein relate to a method of cooling a gas in a rebreather apparatus that includes scrubbing an exhalation gas to produce a recycled gas having a lower concentration of carbon dioxide than the exhalation gas, compressing a refrigerant in a closed-loop system, condensing the refrigerant in the closed-loop system, expanding the refrigerant in the closed-loop system, evaporating the refrigerant in the closed-loop system, transferring heat energy from the recycled gas to the refrigerant, wherein a temperature of the recycled gas decreases during the transferring, and metering a cooled gas to the user.

Other aspects and advantages of the invention will be apparent from the following description and the appended claims.

DETAILED DESCRIPTION

Embodiments of the present disclosure will be described below with reference to the figures. In one aspect, embodiments disclosed herein relate to rebreather breathing apparatuses, or rebreathers, and components incorporated within the apparatus. In particular, embodiments disclosed herein relate to a rebreathing apparatus configured to reduce the temperature of the breathing gas recycled to the user of the apparatus.

A rebreather breathing apparatus according to the present disclosure is referred to as a Multi Mission Rebreather System (MMRBS). A MMRBS is a closed-loop system allowing a user of the MMRBS to recycle their own exhaled breath (a gas) for continued breathing in hazardous or confined spaces. The MMRBS may be used on the surface, for example, by first responders. Since the MMRBS is a closed-loop system, the MMRBS retains energy added to the system (e.g., the gas) in the form of heat, which may increase the temperature of the gas. A MMRBS in accordance with embodiments disclosed herein includes components to alleviate high gas temperatures. According to embodiments of the present disclosure, the MMRBS may include heat sinks, thermoelectric devices, cooling units, or combinations thereof to reduce the temperature of the breathing gas recycled to the user of the MMRBS.

Figure 1:
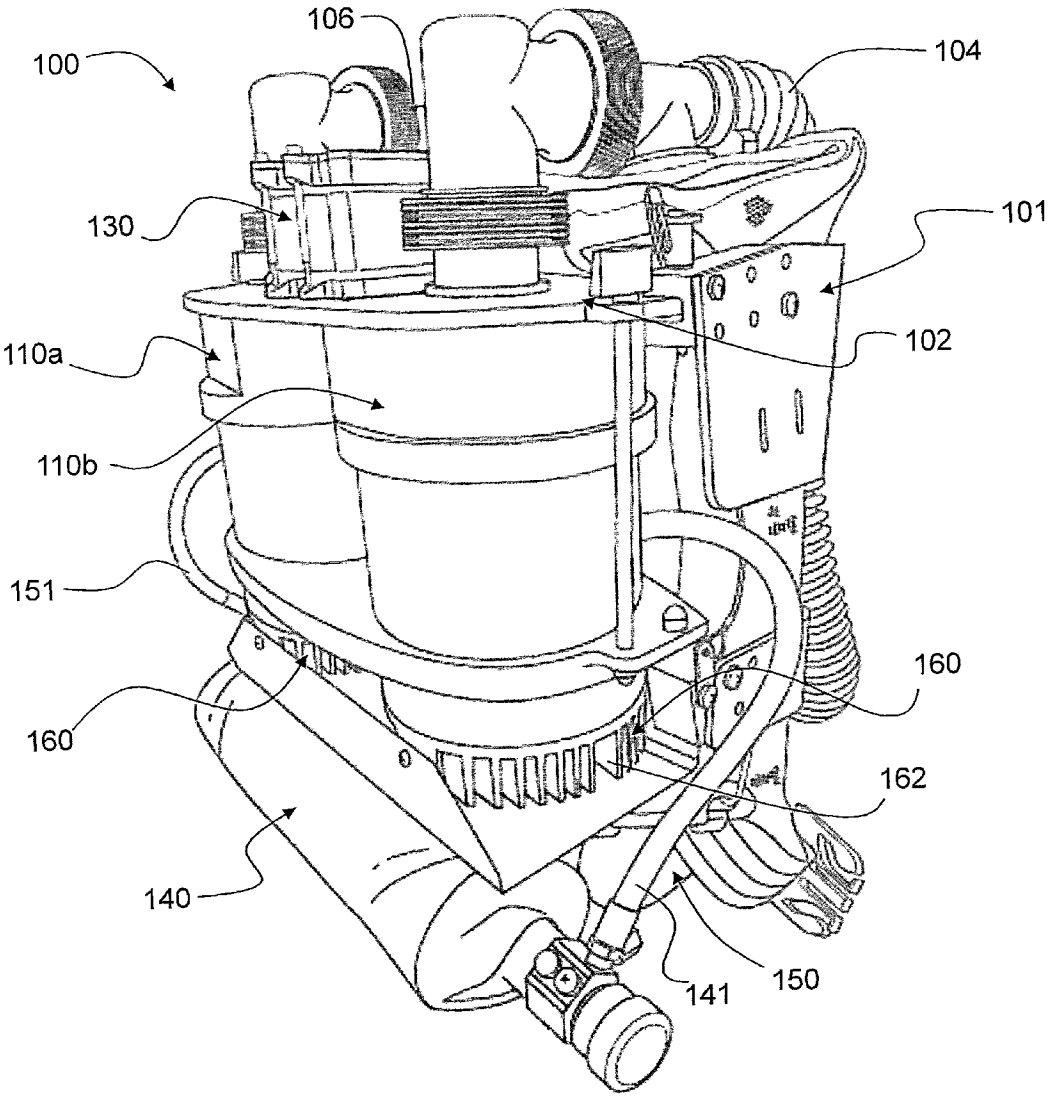
FIG. 1 is a perspective view of a rebreather apparatus according to embodiments of the present disclosure.

Referring initially to FIG. 1, a MMRBS 100 is shown in accordance with embodiments of the present disclosure. The MMRBS 100 includes a mouthpiece (not shown) connected to an inhale hose 104 and an exhale hose 106. The mouthpiece may include a valve which allows the user to exhale to the exhale hose 106 and inhale from the inhale hose 104 using a single mouthpiece. Inhale hose 104 and exhale hose 106 may be made of a flexible material such as a flexible hose or tubing. The MMRBS 100 may include a plurality of scrubber bed units 110. In some embodiments, the exhale hose 106 may be sealingly engaged to an inlet at an upper end of a first scrubber bed unit 110*a*, and the inhale hose 104 may be sealingly engaged to an outlet at an upper end of a second scrubber bed unit 110*b*. Scrubber bed units 110 may be connected via a passageway (not shown) to allow for a gas to flow from the first scrubber bed 110*a* to the second scrubber bed 110*b*.

Figure 3:
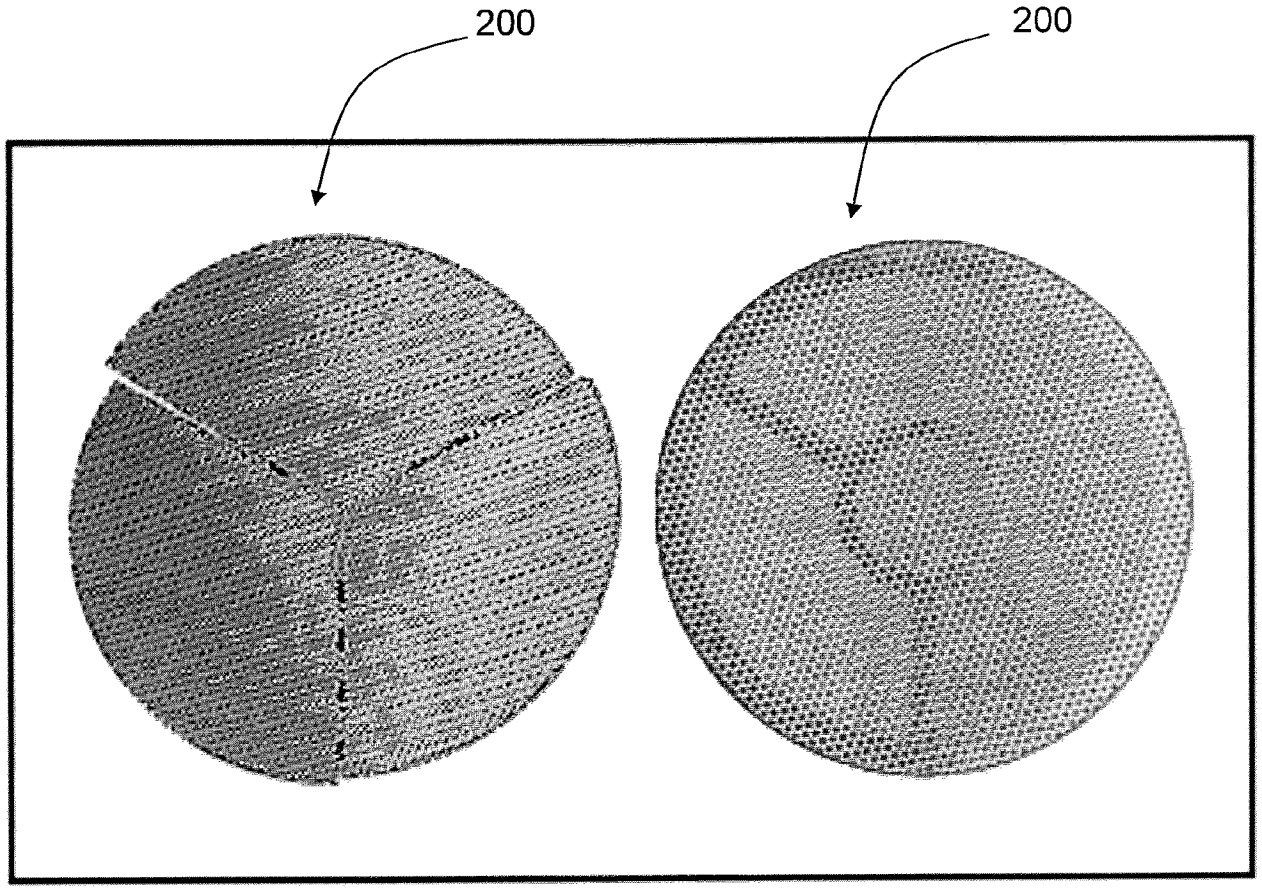
FIG. 3 is a top view of screen inserts according to embodiments of the present disclosure.

Scrubber bed units 110 may include a chemical absorbent to reduce the concentration of $CO_2$ or other impurities from a gas. The chemical absorbent may be, for example, a granular calcium hydroxide, sodium hydroxide, potassium hydroxide, or combinations thereof, to absorb the $CO_2$ from the exhaled gas. Within scrubber bed units 110, a plurality of screen inserts 200 (FIG. 3) may be placed between sections of the chemical absorbent. Screen inserts 200, embodiments of which are shown in FIG. 3, may reduce gas channeling inside the scrubber bed units 110 thereby allowing for a uniform gas flow therethrough. In some embodiments, the shape, location, and/or material of screen inserts 200 may transfer heat from the gas flow to the scrubber bed units 110. Screen inserts 200 may be made of a metallic material, such as a stainless steel, ceramic, plastic, or any material capable of withstanding heat from an exothermic chemical reaction occurring within the scrubber bed units 110.

Figure 2:
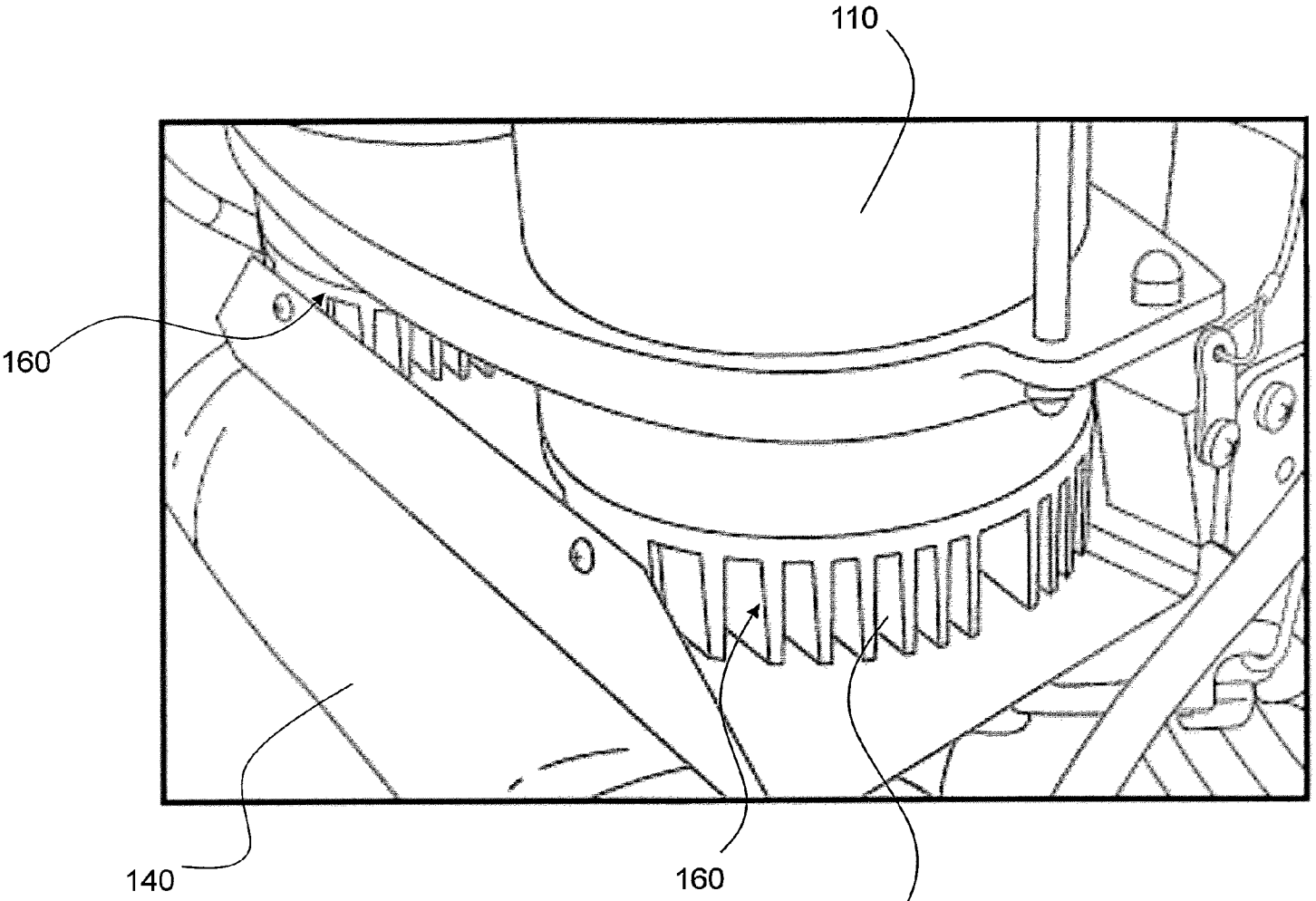
FIG. 2 is a close perspective view of heat sinks according to embodiments of the present disclosure.

Referring to FIG. 1, downstream of scrubber bed units 110 are heat sinks 160 which are operatively connected to the scrubber beds 110. FIG. 2 illustrates a close perspective view of heat sinks 160. Heat sinks 160 may include a plurality of fins 162, as shown in FIGS. 1 and 2, for an increased surface area to transfer heat to the surrounding environment. Heat sinks 160 may further include thermoelectric devices (not shown), such as but not limited to, a Peltier block. In some embodiments, as shown in FIG. 1, heat sinks 160 may be attached directly to a lower end of the scrubber bed units 110. In such embodiments, the thermoelectric devices may be positioned between a lower end of scrubber bed units 110*s* and an upper end of heat sinks 160. The thermoelectric devices create a thermoelectric effect, which provides the direct conversion of temperature differences to electric voltage and vice versa. A thermoelectric device creates a voltage when there is a different temperature on each side of the thermoelectric device. Conversely, when a voltage is applied to a thermoelectric device, a temperature difference, known as the Peltier effect, is created. For example, when a voltage is applied to thermoelectric devices, the thermoelectric devices may be used to remove heat from an interfacing object, such as the scrubber bed units 110.

An oxygen supply tank 140 may be included in MMRBS 100 to adjust, or makeup, the oxygen levels in the treated gas if the measured oxygen concentration of the treated gas falls below a threshold. In some embodiments, the oxygen supply tank 140 may be electronically coupled to an electronics package 130. Sensors (not shown) may be mounted proximate an outlet of the scrubber bed units 110 to measure oxygen and $CO_2$ levels within the treated gas exiting the scrubber bed units 110 and add an amount of oxygen from the oxygen supply tank 140 in response to the measured oxygen concentration of the treated gas. In other embodiments, the MMRBS 100 may also include a diluent supply tank 150. The diluent supply tank 150 may provide, for example, air or nitrox, to the treated gas in the scrubber bed units 110 if the treated gas becomes oxygen rich based upon the measured oxygen concentration of the treated gas via the electronics package 130. According to some embodiments, the flow of oxygen from the oxygen supply tank 140 and/or the flow of diluent from the diluent supply tank 150 may be controlled via a solenoid valve (not shown) proximate the electronics package 130.

Figure 4:
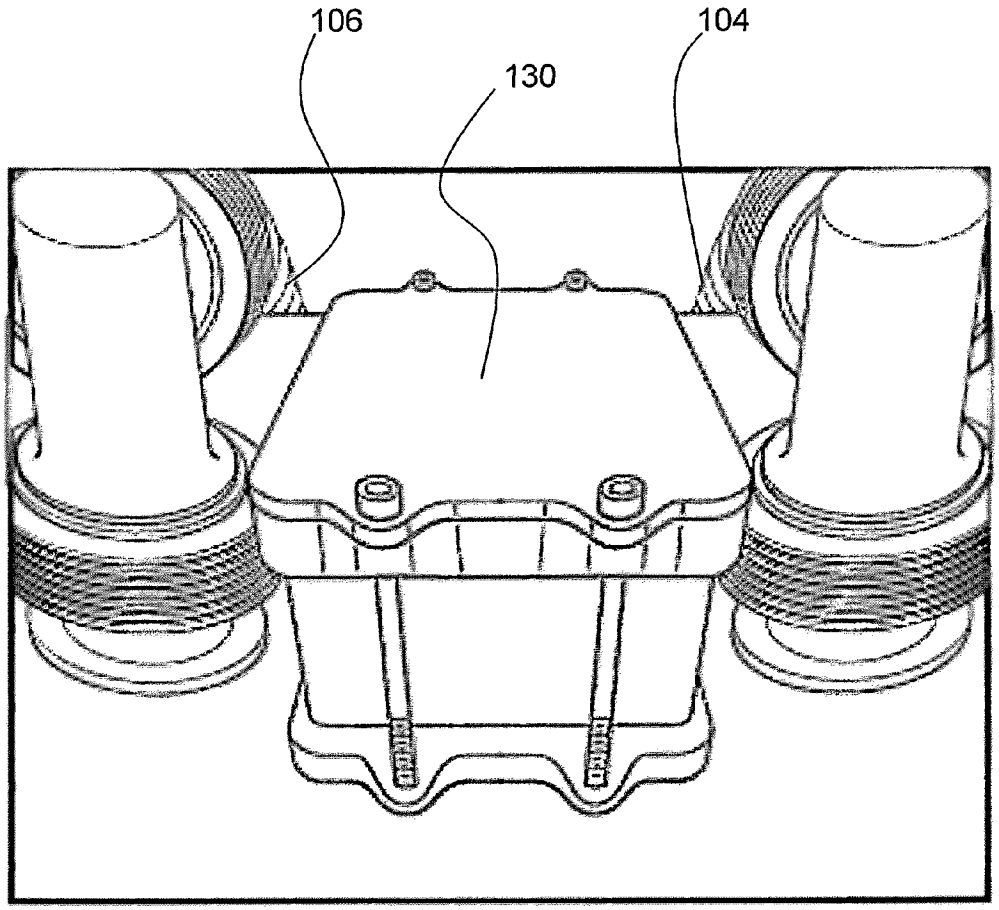
FIG. 4 is a side view of a sealed electronics package according to embodiments of the present disclosure.

The electronics package 130, shown in FIGS. 1 and 4, may include a sealed compartment in which the electronics and other sensitive elements of MMRBS 100 are housed allowing the unit to be used in hazardous or wet environments without damage to the electronics. The electronics package 130 may include software allowing the electronics package 130 to be used in a variable hyperbaric environment where the electronics package 130 may be self-correcting for changes in environmental pressure. In some embodiments, the electronics package 130 may include a positive pressure enclosure, the positive pressure supplied by the diluent supply tank 150 and/or the oxygen supply tank 140. In such embodiments, the electronics package 130 may include controls for self-correcting the positive pressure in response to changes in environmental pressure. The electronics package 130 may further include circuitry and a power source, such as a battery, for operating the MMRBS 100. The MMRBS 100 may include electronics outside of electronics package 130 such as visual display unit(s) viewable to the user and gas sensors mounted on scrubber bed unit 110 proximate an outlet of the scrubber bed unit 110 to measure oxygen and $CO_2$ levels within the treated gas exiting scrubber bed unit 110.

According to some embodiments, as shown in FIG. 1, the MMRBS 100 may be mounted on a frame 101 which can be worn by a single user such that the hands of the user are free, for example, on the body of the user, so that the MMRBS 100 may be carried "hands free". In such embodiments, the frame 101 may include any one of a harnesses, a plurality of shoulder straps, a waist belt, or combinations thereof. In some embodiments, the MMRBS 100 may include a brace 102 to stabilize and secure the scrubber beds 110 to the frame 101. The brace 102 may include a retention mechanism that applies a force on an upper end and/or a lower end of the scrubber bed units 110 to secure an upper end and/or a lower end of the scrubber bed units 110 closed thereby isolating the scrubber bed units 110 from the surrounding environment. The brace 102 and/or scrubber bed units 110 may further include a plurality of seals proximate an upper end and/or a lower end of the scrubber bed units 110 to provide additional sealing from the surrounding environment. In some embodiments, the electronics package 130 may be mounted to the brace 102 such that the electronics package 130 is proximate the components of the MMRBS 100 which may be operatively connected to the electronics package 130, such as the oxygen supply tank 140, the diluent supply tank 150, and the makeup line 170. In such embodiments, the oxygen supply tank 140 and the diluent supply tank 150 may be operatively connected to the electronics package 130 via oxygen line 141 and diluent line 151, respectively. The oxygen line 141, diluent line 151, and makeup line (not shown) may be comprised of a metallic material, ceramic, plastic, or any other material capable of transporting a gas.

Still referring to FIG. 1, in operation, a user exhales a gas into a mouthpiece (not shown) and the exhaled gas passes through the exhale hose 106 before entering the first scrubber bed unit 110*a* to be "scrubbed". As shown in FIG. 1, MMRBS 100 may include more than one scrubber bed unit 110 for increased $CO_2$ reduction. In some embodiments, the exhaled gas may flow through the first scrubber bed 110*a* before entering and flowing through the second scrubber bed unit 110*b*, i.e., the first and second scrubber beds 110*a*, 110*b* are connected in series. In other embodiments, the exhaled gas may flow through the first and second scrubber bed units 110*a*, 110*b* in parallel. The scrubber beds 110 may be modular to accommodate variable usage durations. The exhaled gas undergoes an exothermic reaction with the chemical absorbent inside the scrubber beds 110 to produce a treated gas. The exothermic reaction releases heat, which increases the temperature of the scrubber beds 110 and the treated gas to a temperature ranging from about 160 to about 190 degrees Fahrenheit (about 66 to about 88 degrees Celsius).

The heated treated gas may transfer some energy to the surrounding environment through the heat sinks 160 attached directly to the scrubber bed units 110. In some embodiments, the thermoelectric devices (not shown) may increase the amount of energy transferred to the surrounding environment. In such embodiments, heat sinks 160 and thermoelectric devices are capable of substantially removing the energy added to the gas during the scrubbing process within the scrubber bed units 110. According to some embodiments, MMRBS 100 including heat sinks 160, thermoelectric devices, or a combination thereof, may lower the temperature of a treated gas to a temperature ranging from about 100 to about 120 degrees Fahrenheit (about 38 to about 49 degrees Celsius).

The treated gas flows from an outlet of the second scrubber bed unit 110*b* to the inhale hose 104 where the gas flows back to the user to be inhaled through the mouthpiece. In operation, and in response to the breathing of the user, the exhaled gas flows from the user to scrubber beds 110 through exhale hose 106, through scrubber beds 110, and back to the user through inhale hose 104. Throughout the MMRBS 100 operation, gas sensors mounted proximate an outlet of the scrubber beds 110 measure oxygen and $CO_2$ levels within the treated gas exiting the scrubbed beds 110 and electronically communicates with the electronics package 130 to meter the oxygen supply tank 140 and/or the diluent supply tank 150 as necessary to achieve a breathable mixture. In some embodiments, MMRBS 100 may include a manual valve (not shown) to manually meter the oxygen supply tank 140 and the diluent supply tank 150, independent of the measured oxygen and $CO_2$ levels and the electronics package 130 operation.

Figure 5:
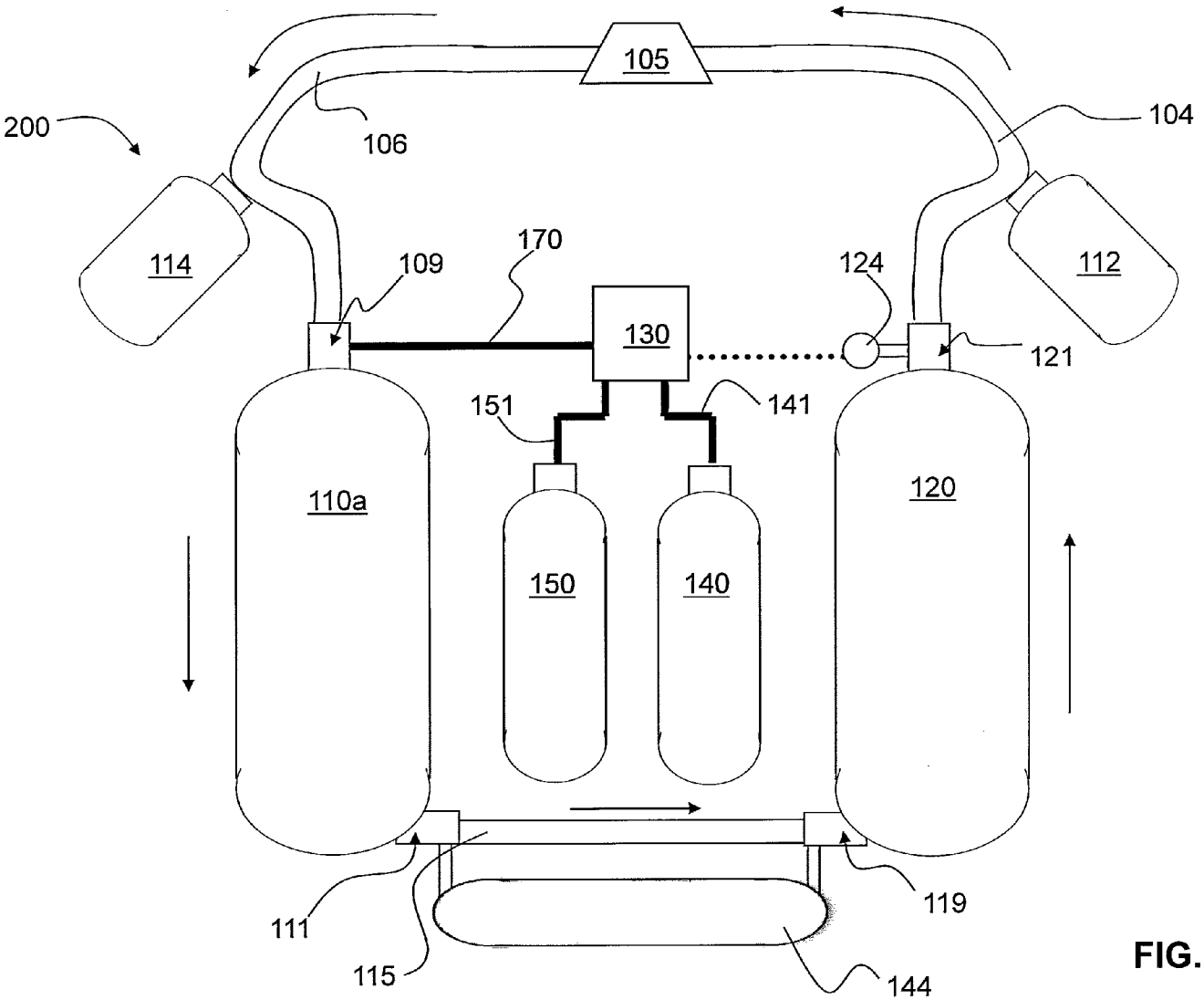
FIG. 5 is a schematic of a cooling rebreather apparatus according to embodiments of the present disclosure.

Referring now to FIG. 5, another embodiment of a rebreather apparatus in accordance with embodiments disclosed herein is shown. In light of FIG. 1, like components in FIG. 5 have the same reference number. As shown in FIG. 5, MMRBS 200 includes a first scrubber bed 110*a* and a cooling unit 120 connected in series via passageway 115. A mouthpiece 105 may be attached to a larger facemask (not shown) and the inhale hose 140 and the exhale hose 106. An exhalation counter lung 114 may be attached to the exhale hose 106 upstream of an inlet 109 of the first scrubber bed 110*a*. The exhalation counter lung 114 expands and contracts when the user breathes, allowing the total volume of gas in the MMRBS 200 to remain constant throughout the breathing cycle while providing a backpressure on the exhaled gas. The MMRBS 200 further includes an inhalation counter lung 112 attached to the inhale hose 104 between the mouthpiece 105 and an outlet 121 of the cooling unit 120 to provide a backpressure on the gas to be inhaled. Shown in FIG. 5, the arrows illustrate the direction of gas flow throughout MMRBS 200.

In some embodiments, a scrubber bed outlet 111 and a cooling unit inlet 119 may be coupled to a water trap 144, where any moisture or water byproduct from the $CO_2$ scrubbing chemical reaction in the first scrubber bed 110*a* and the cooling unit 120 may be collected. In such embodiments, the scrubber bed outlet 111 and the cooling unit inlet 119 may each be coupled to at least one valve (not shown), such as a check valve, to control the flow of treated gas from the first scrubber bed 110*a* to the cooling unit 120 and/or the flow of water byproduct from the first scrubber bed 110*a* and the cooling unit 120 to the water trap 144. The water trap 144 may be sized to collect water for the duration of the usage of the MMRBS 200. After usage of the MMRBS 200, the water trap 144 may be emptied. Although not shown in FIG. 5, MMRBS 200 may be attached to a frame and include a brace, as discussed above, for a user of MMRBS 200 to carry the MMRBS 200 hands free. According to some embodiments, MMRBS 200 may be attached to or worn in combination with a full-body garment, for example, a hazardous materials suit, such that the space inside of the full-body garment is supplied with a cooled treated gas.

At least one sensor 124 may be coupled to the cooling unit 120, proximate cooling unit outlet 121, to measure the concentration of oxygen and $CO_2$ levels within the cooled treated gas exiting the cooling unit 120. Sensor 124 provides an electronic signal containing the measured oxygen and $CO_2$ levels within the cooled treated gas to the electronics package 130. An oxygen supply tank 140 may be included in MMRBS 200 to adjust, or makeup, the oxygen levels in the cooled treated gas if the measured oxygen concentration of the cooled treated gas falls below a threshold. In other embodiments, the MMRBS 200 may also include a diluent supply tank 150. The diluent supply tank 150 may provide, for example, air or nitrox, to the cooled treated gas if the gas becomes oxygen rich based upon the measured oxygen concentration. In some embodiments, the oxygen supply tank 140 and the diluent supply tank 150 may be coupled to the electronics package 130 via oxygen line 141 and diluent line 151, respectfully. In such embodiments, a solenoid valve (not shown) may meter the oxygen and diluent, in response to the measured oxygen concentration of the cooled treated gas, to the first scrubber bed inlet 109 via makeup line 170. In other embodiments, a solenoid valve (not shown) may meter the oxygen and diluent, in response to the measured oxygen concentration of the cooled treated gas, to the cooling unit outlet 121 via makeup line 170. In some embodiments, MMRBS 200 may include a manual valve (not shown) to manually meter the oxygen supply tank 140 and the diluent supply tank 150, independent of the measured oxygen and $CO_2$ levels and the electronics package 130 operation.

Without cooling the treated gas, the user may encounter treated gas having a temperature in the range of about 140 to about 200 degrees Fahrenheit (about 60 to about 93 degrees Celsius), causing discomfort and even respiratory injury or death. As discussed above, the heat sinks 160 and thermoelectric devices of MMRBS 100 are capable of substantially removing the energy added to the treated gas during the scrubbing process within the scrubber bed units 110. However, in order to cool the treated gas beyond removing energy added to the treated gas, a cooling unit may be included to cool or lower the temperature of the treated gas.

Figure 6:
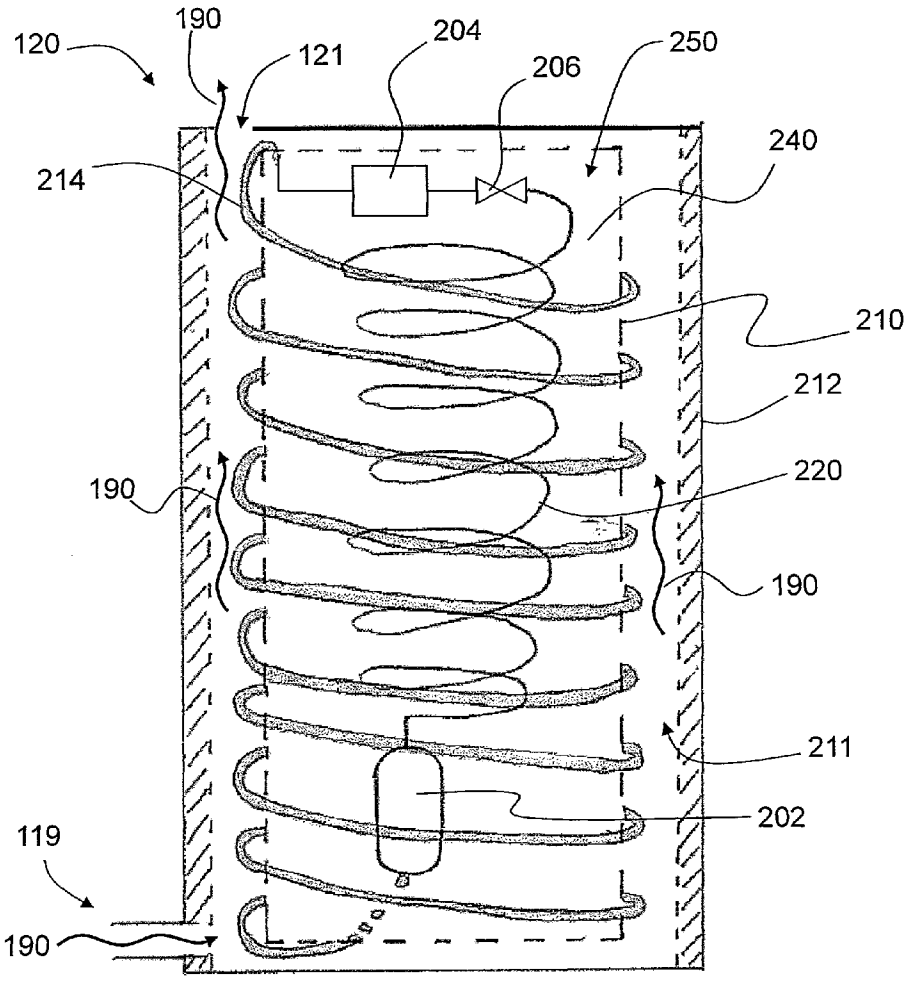
FIG. 6 is a cross-sectional side view of a cooling unit according to embodiments of the present disclosure.
Figure 7:
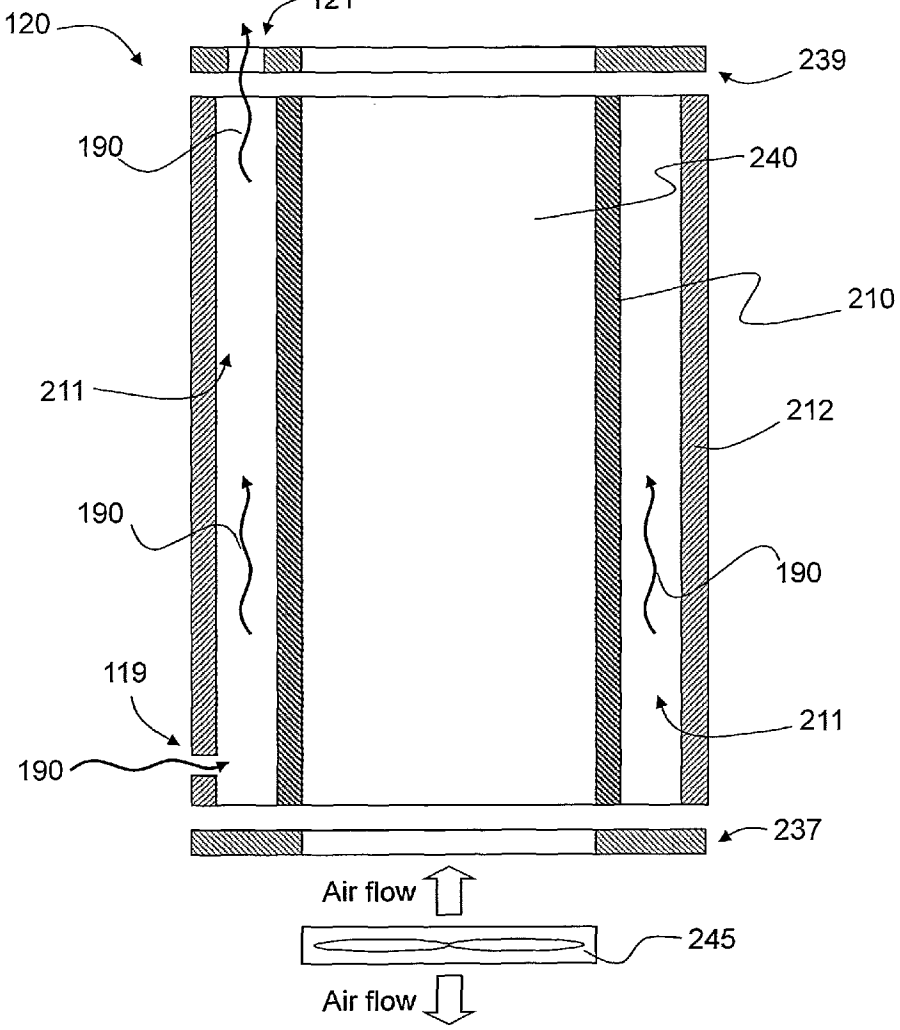
FIG. 7 is an exploded, partial cross-sectional side view of a cooling unit according to embodiments of the present disclosure.

Referring to FIGS. 6 and 7, a cooling unit 120 according to embodiments of the present disclosure is shown. In some embodiments, the cooling unit 120 includes an outer shell 212 and an inner shell 210, the outer shell 212 may be connected to the cooling unit inlet 119 and outlet 121. An annulus 211 is formed between outer shell 212 and inner shell 210. Referring to FIG. 6, the outer shell 212 is shown in cross-section to illustrate the annulus 211 and inner shell 210; however, the inner shell 210 is shown with a dashed line to illustrate the components within the inner shell 210. In some embodiments, the outer shell 212 and the inner shell 210 are cylinders with open ends. In such embodiments, as shown in FIG. 7, a bottom seal 237 and a top seal 239 may securely seal a lower end and an upper end, respectively, of the outer shell 212 and the inner shell 210. The configuration of the outer and inner shells 212, 210 allows the cooling unit inlet and outlet 119, 121 to fluidly communicate with the annulus 211. Bottom seal 237 and top seal 239 retain the treated gas in annulus 211 before the cooled treated gas exits the cooling unit 120 via cooling unit outlet 121. An inner radial space 240 of inner shell 210 may fluidly communicate with the surrounding environment. One of ordinary skill in the art will understand that the shape of the outer and inner shells 212, 210 may vary without departing from the scope of the present disclosure. The outer and inner shells 212, 210 may be comprised of a ceramic or plastic, such as a thermoplastic, or any material capable of forming a lightweight, rigid shell.

The cooling unit 120 may further include a closed-loop cooling system, or cooling loop 250, including at least a pump or compressor 202, a condenser coil 220, an expansion valve 206, and an evaporator 204, each disposed in the inner shell 210, and an evaporator coil 214 wrapped around the inner shell 210. In some embodiments, inner shell 210 may include holes or openings to allow for the evaporator coil 214 to pass and wrap around the inner shell 210. The condenser coil 220 connects an outlet of the pump or compressor 202 to an inlet of the expansion valve 206. The evaporating coil 214 connects an outlet of the expansion valve 206 to an inlet of the pump or compressor 202. Evaporator 204 is installed downstream of the expansion valve 206 and upstream from the pump or compressor 202 such that evaporator is disposed in the inner shell 210, for example, as shown in FIG. 6. The pump or compressor 202 is wired to a power source (not shown), for example, a NiCad battery. In some embodiments, the power source may be located exterior to the cooling unit 120, for example, in the electronics package 130.

Since the treated gas flows through the annulus 211, the evaporating coil 214 may be located in the annulus 211 in order to create contact therebetween. In some embodiments, the evaporating coil 214 may be wrapped around the inner shell 210. As shown in FIG. 6, the compressor 202, condensing coil 220, evaporator 204, and expansion valve 206 may be located within the inner shell 210, for example, to create a greater flow area in the annulus 211 for the treated gas. In some embodiments, the condenser coil 220 is constructed of a material having high thermal conductivity, such as a metallic material, for example, copper, gold, aluminum, or alloys thereof.

In operation, a refrigerant fluid circulates through the cooling loop 250, flowing through the pump or compressor 202, the condenser coil 220, the expansion valve 206, the evaporator 204, and the evaporator coil 214. According to some embodiments, the refrigerant fluid may consist of a fluorocarbon mixture or any compound capable of undergoing phase transitions from liquid to gaseous states and back to a liquid. For example, carbon tetrafluoride (refrigerant R14) may be used. The refrigerant fluid enters the pump or compressor 202 in a full vapor state where the vapor is compressed, increasing the pressure and temperature of the refrigerant. The refrigerant fluid then enters the condenser coil 220. The condenser coil 220 condenses the refrigerant fluid from a vapor into a liquid by transferring heat from the refrigerant fluid to the surrounding environment at constant pressure. The high pressure, liquid refrigerant fluid flows from the condenser coil 220 through an expansion valve 206. The expansion valve 206 allows a portion of the high pressure, liquid refrigerant fluid to enter the evaporating coil 214 causing the refrigerant fluid entering the evaporating coil 214 to rapidly expand or flash vaporize, thus decreasing the pressure and temperature of the refrigerant fluid, and wherein a portion of the refrigerant fluid in the evaporating coil 214 is now in gaseous state. The refrigerant is now a mixture of vapor and liquid at a lower temperature and pressure as it enters the evaporator 204. The refrigerant fluid completely vaporizes by transferring heat from the surrounding environment to the refrigerant fluid at constant pressure while flowing through the evaporator 204 and the evaporating coil 214 back to the pump or compressor 202 to continue through the cooling loop 250.

In some embodiments, as shown in FIG. 7, fan 245 may be disposed in or coupled to the inner shell 210 and configured to force air across at least one of the condensing coil 220 and evaporator 204, further transferring heat between the refrigerant fluid and the surrounding environment. In such embodiments, the fan 245 may be configured to draw air from the surrounding environment and force the air upwardly through a bottom end of the inner shell 210 and out through a top end of the inner shell 210. In other embodiments, the fan 245 may be configured to draw air from the surrounding environment and force the air downwardly through a top end of the inner shell 210 and out through a bottom end of the inner shell 210.

As discussed above, heated treated gas exits the scrubber bed outlet 111 and flows to the cooling unit inlet 119 to start the cooling process within the cooling unit 120. The gas flows through a passageway 115 from the first scrubbing bed unit 110*a* to the cooling unit 120. The MMRBS 200 is configured such that the heated treated gas flows through the annulus 211 of the cooling unit 120 and across the evaporating coil 214 along flow path 190. The heated treated gas exchanges or transfers heat to the evaporating coil 214 having a lower temperature as the heated treated gas flows through the annulus 211, cooling the heated treated gas to a cooled treated gas while warming the refrigerant fluid. The cooled treated gas exits the cooling unit 120 at an upper end through cooling unit outlet 121 where it enters the inhalation hose 104 (FIG. 5). In some embodiments, a valve may be connected to cooling unit outlet 121 such that the user of the MMRBS 200 may meter the flow rate of the cooled treated gas from the cooling unit 120 to the exhale hose 104.

The temperature of the heated treated gas entering the cooling unit 120 may range from about 140 to about 200 degrees Fahrenheit (about 60 to about 93 degrees Celsius). According to some embodiments, cooling unit 120 operates to cool a heated treated gas to a target temperature ranging from about 70 to about 90 degrees Fahrenheit (about 21 to about 32 degrees Celsius). In such embodiments, the cooling unit 120 is capable of cooling a heated treated gas to the target temperature in a duration ranging from about two to three minutes. In some embodiments, the cooling unit 120 may cool a heated treated gas to the target temperature in as little as two minutes.

The rebreather apparatus described in embodiments above may be capable of operating and cooling treated gas for up to three hours in a single mission, or uninterrupted usage. The rebreather apparatus may operate for a longer duration with replacement of at least the oxygen supply tank 140.

The usage duration of conventional rebreather apparatuses may be limited due to an increasing temperature of the treated gas flowing through the rebreather apparatus, for example, as a product of the $CO_2$ removal process. Rebreather apparatuses including heat sinks and thermoelectric devices may remove energy in the form of heat from the treated gas to the user of the rebreather apparatus, but may be limited to removing additional heat added to the system via the scrubber beds. Rebreather apparatuses including cooling units are capable of significantly lowering the temperature of the treated gas flowing to the user of the rebreather apparatus. As described above, a cooling unit may lower the temperature of the treated gas ranging from about 70 to about 90 degrees Fahrenheit (about 21 to about 32 degrees Celsius). According to embodiments of the present disclosure, rebreather apparatuses may be reconfigured to include any number of scrubber bed units and any number of cooling units such that the cooling units are located downstream of the scrubbed bed units in relation to the flow of the treated gas.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. An apparatus comprising:

a scrubber bed; and a cooling unit operatively connected to the scrubber bed, the cooling unit comprising:

a compressor;

a condensing coil operatively connecting the compressor to an expansion valve;

an evaporating coil operatively connecting the expansion valve to the compressor; and a first fluid circulating through the compressor, the condensing coil, the expansion valve, and the evaporating coil;

a frame configured for a user to carry the apparatus; and an inner shell housing the compressor, the condensing coil, and the expansion valve; and an outer shell, wherein the inner shell and the outer shell form an annulus;

wherein the evaporating coil substantially surrounds the inner shell.

2. The apparatus of claim 1, further comprising a second fluid circulating from the scrubber bed to the cooling unit, and wherein the second fluid flows in the annulus of the cooling unit.

3. The apparatus of claim 2, wherein the second fluid contacts the evaporating coil to transfer heat between the first fluid and the second fluid.

4. The apparatus of claim 3, wherein the temperature of the second fluid decreases and the temperature of the first fluid increases.

5. The apparatus of claim 4, wherein the cooling unit is configured to cool the second fluid having a temperature ranging from about 140 to about 200 degrees Fahrenheit to a lower temperature ranging from about 70 to about 90 degrees Fahrenheit.

6. The apparatus of claim 5, wherein the cooling unit is configured to cool the second fluid in a duration ranging from about two to about three minutes.

7. The apparatus of claim 5, wherein the cooling unit is configured to operate for a period up to 3 hours.

8. The apparatus of claim 2, further comprising:

an evaporator located between the expansion valve and the compressor.

9. The apparatus of claim 8, further comprising:

a fan coupled to the cooling unit and configured to force a third fluid across at least one of the condensing coil and the evaporator.

10. The apparatus of claim 2, further comprising:

at least one sensor configured to measure a concentration of oxygen within the second fluid;

an electronics package operatively connected to the at least one sensor; and an oxygen supply tank operatively connected to the scrubber bed via the electronics package;

wherein the electronics package is at least configured to control a flow of oxygen from the oxygen supply in response to the measured oxygen concentration from the at least one sensor.

11. The apparatus of claim 10, wherein a valve controls the flow of oxygen through the electronics package.

* * * * *